US008810115B2

(12) United States Patent
Pariente et al.

(10) Patent No.: US 8,810,115 B2
(45) Date of Patent: Aug. 19, 2014

(54) SPARKPLUG FOR AN INTERNAL COMBUSTION ENGINE

(75) Inventors: Marc Pariente, Voisins le Bretonneux (FR); Andre Agneray, Boulogne-Billancourt (FR); Xavier Jaffrezic, Guyancourt (FR)

(73) Assignee: Renault S.A.S., Boulogne-Billancourt (FR)

( * ) Notice: Subject to any disclaimer, the term of this patent is extended or adjusted under 35 U.S.C. 154(b) by 0 days.

(21) Appl. No.: 13/822,217

(22) PCT Filed: Sep. 8, 2011

(86) PCT No.: PCT/FR2011/052057

§ 371 (c)(1),
(2), (4) Date: Jul. 25, 2013

(87) PCT Pub. No.: WO2012/032268

PCT Pub. Date: Mar. 15, 2012

(65) Prior Publication Data

US 2013/0293086 A1 Nov. 7, 2013

(30) Foreign Application Priority Data

Sep. 10, 2010 (FR) ..... 10 57206

(51) Int. Cl.
*H01T 13/00* (2006.01)

(52) U.S. Cl.
CPC ..... *H01T 13/00* (2013.01)
USPC ..... 313/118; 315/57

(58) Field of Classification Search
CPC ..... H01T 13/00
USPC ..... 313/118; 315/57
See application file for complete search history.

(56) References Cited

U.S. PATENT DOCUMENTS

| | | | | |
|---|---|---|---|---|
| 2,459,856 | A | 1/1949 | Wall | |
| 4,149,508 | A * | 4/1979 | Kirk et al. | 123/598 |
| 4,224,554 | A * | 9/1980 | Nishio et al. | 315/53 |

(Continued)

FOREIGN PATENT DOCUMENTS

FR 2 859 830 3/2005

OTHER PUBLICATIONS

International Search Report Issued Jan. 20, 2012 in PCT/FR11/052057 Filed Sep. 8, 2011.

*Primary Examiner* — Mary Ellen Bowman
(74) *Attorney, Agent, or Firm* — Oblon, Spivak, McClelland, Maier & Neustadt, L.L.P.

(57) ABSTRACT

A sparkplug including an induction coil and an electrode. The induction coil includes two end portions, the electrode extending in a continuation of one of the two end portions. The induction coil includes a conducting wire wound to form a succession of turns, the one of the two end portions having a terminal turn connected to the electrode. The one of the two end portions includes a plurality of coaxial end turns that extend between the terminal turn and an upstream turn, and the terminal turn has a diameter smaller than the diameter of the upstream turn so to reduce strength of the electric field induced in the one of said two end portions near the terminal turn.

20 Claims, 4 Drawing Sheets

(56) References Cited

U.S. PATENT DOCUMENTS

| | | | | |
|---|---|---|---|---|
| 4,903,674 | A | 2/1990 | Bassett et al. | |
| 6,550,463 | B1 * | 4/2003 | Schmolla | 123/606 |
| 6,668,810 | B1 * | 12/2003 | St. John et al. | 123/634 |
| 7,777,401 | B2 * | 8/2010 | Jaffrezic et al. | 313/134 |
| 8,278,807 | B2 * | 10/2012 | Agneray et al. | 313/118 |
| 2002/0158740 | A1 * | 10/2002 | Paul et al. | 336/96 |
| 2003/0189476 | A1 | 10/2003 | Nagata et al. | |
| 2009/0114179 | A1 * | 5/2009 | Jaffrezic et al. | 123/169 P |
| 2012/0186568 | A1 * | 7/2012 | Steinberger | 123/634 |
| 2013/0234581 | A1 * | 9/2013 | Makarov et al. | 313/141 |

* cited by examiner

Fig.3
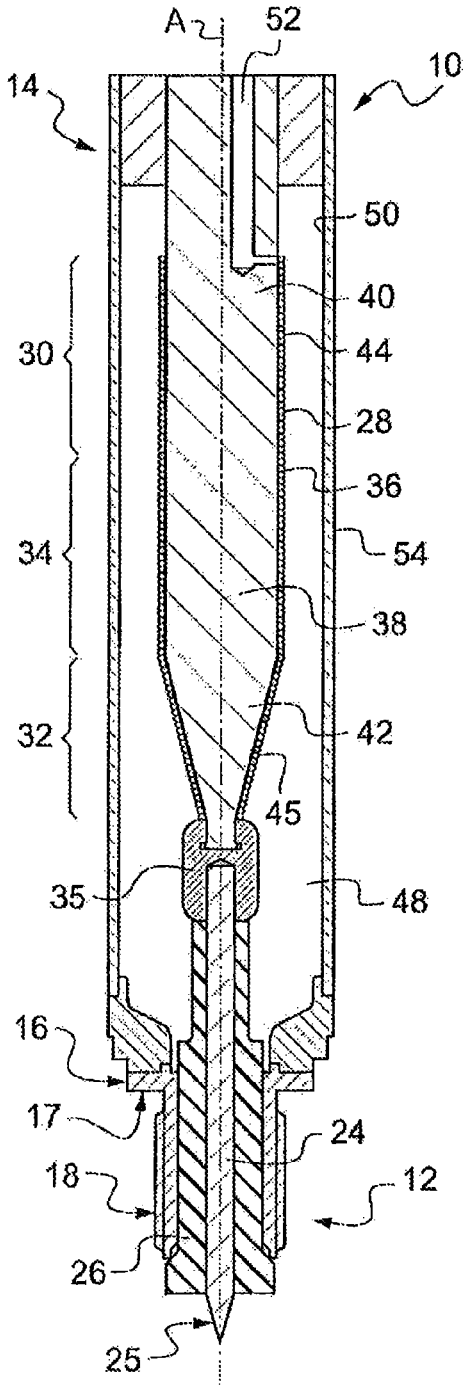
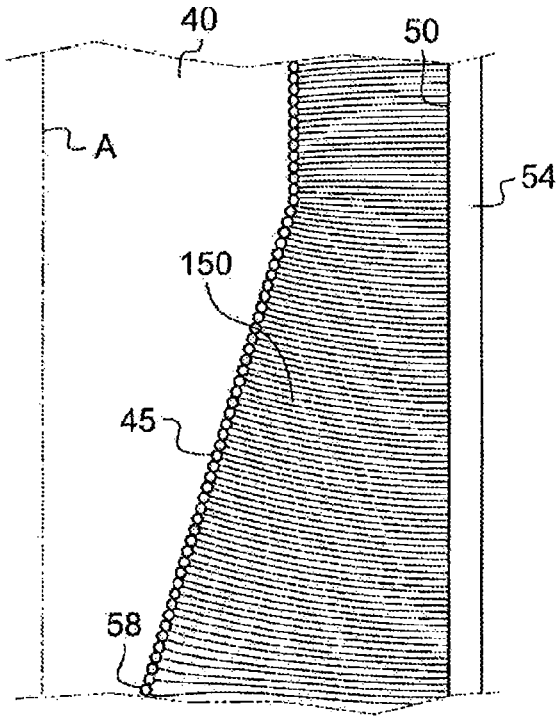
Fig.4

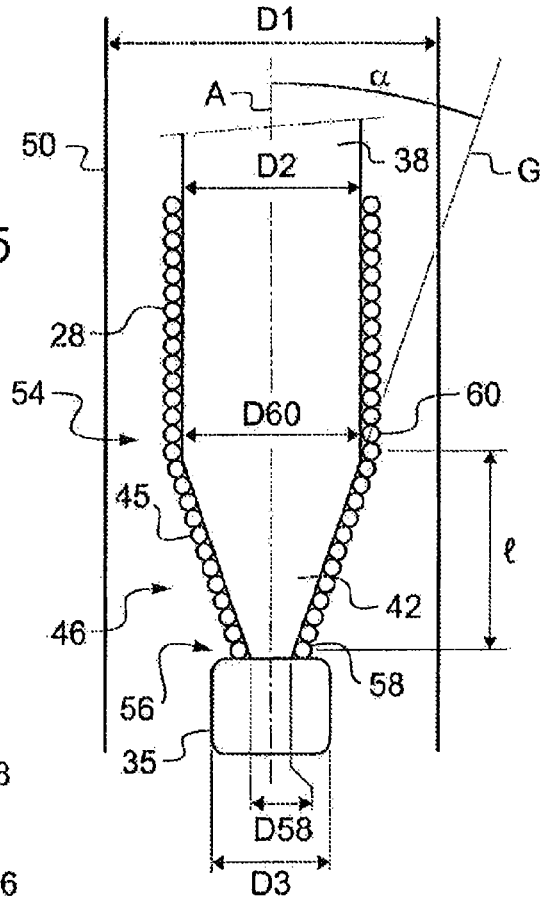
Fig.5
Fig.6
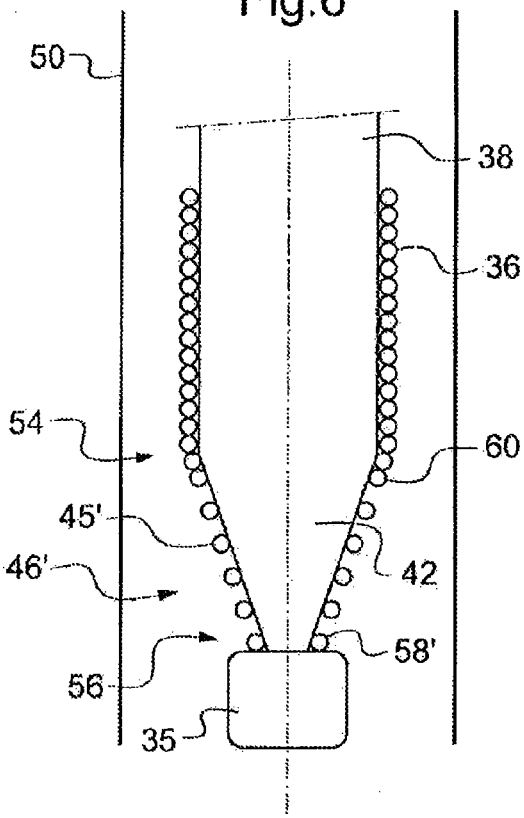
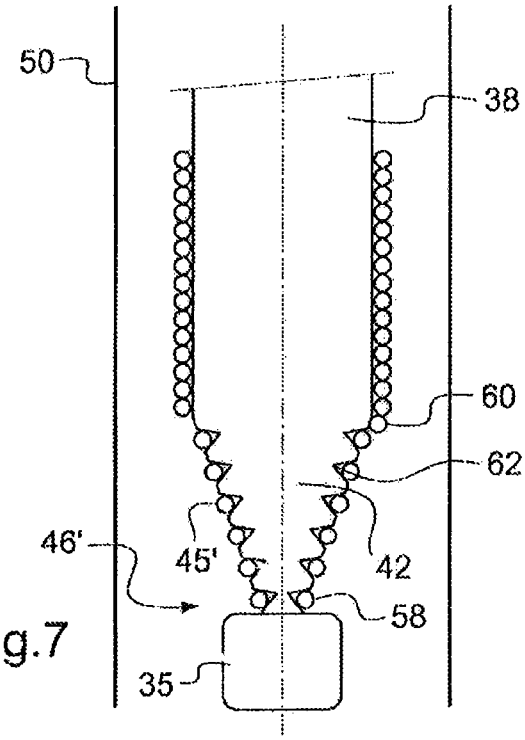
Fig.7

SPARKPLUG FOR AN INTERNAL COMBUSTION ENGINE

The present invention relates to a sparkplug for an internal combustion engine and more precisely for the controlled ignition of this type of engine. The invention relates more particularly to a sparkplug which comprises an induction coil coupled to a sparkplug electrode.

Sparkplugs of the radiofrequency type make it possible to develop, based on an electrode excited by a radiofrequency high AC voltage, a multifilament discharge considerably accelerating the start of combustion. It is possible to refer to document FR 2 859 830 which describes such a sparkplug. With reference to FIG. 1 (which corresponds to FIG. 18 of document FR 2 859 830), such known radiofrequency sparkplugs 110 comprise an induction coil 112 and a high-voltage central electrode 106 coupled to this induction coil 112. The high-voltage central electrode 106 is adjusted in line with the coil 112. The sparkplug 110 also comprises a metal cap 103 of cylindrical shape which is designed to be screwed into an orifice opening inside the combustion engine of the cylinder of an engine and which constitutes a ground electrode in the center of which the high-voltage central electrode 106 extends coaxially. In order to do this, the metal cap 103 is electrically connected to ground. Moreover, the high-voltage central electrode 106 is insulated from the ground electrode 103 by means of an insulator 100, such as for example a ceramic sleeve. We are thus in the presence of a serial resonator, consisting of the induction coil 112 and of a capacitor which are connected in series, the capacitor consisting of at least the central electrode 106, the ceramic 100 and the ground electrode 103. Moreover, the sparkplug 110 comprises a cylindrical shield 132 which covers the induction coil 112. The shield may form part of the body 135 of the sparkplug 110, preferably made of metal, or it may be separate by being fitted to the inner surface of the body 135.

In addition to the fact that the induction coil 112 is produced around an insulating mandrel 134, it is itself surrounded by an insulation speed 133 which may be of a solid, liquid or gaseous nature. The insulating mandrel 134 is a cylinder about which a conducting wire 112 is wound helically forming turns so as to obtain a solenoid. At one of its ends, the conducting wire 112 is connected to the high-voltage central electrode 106 while at the opposite end, the conducting wire 112 is connected to a connection terminal 131 allowing the electrical power supply.

The use of a single conducting wire 112 to form a single-layer solenoid induces a rise in voltage along the induction coil. This rise in voltage, which takes place turn by turn, induces a very considerable electrical field over at least the last turn which is connected to the high-voltage central electrode 106. This last turn is also called the terminal turn. The electrical field at the last turn tends to exceed the critical electrical field of the order of 15 to 20 kV/mm of certain insulating materials, which may generate sparks at this terminal turn. These sparks are capable of causing the early degradation notably of the insulator of the sparkplug. With reference to FIG. 2, this phenomenon is located mainly on the last turn of the coil 112. The last turn, or terminal turn, bears the reference 112*a*. In FIG. 2, the electrical field is represented by field lines 150 which extend between the shield 132 and each turn of the coil 112. In this figure, at least the terminal turn 112*a* sees the electrical field amplified by the concentration of the electrical field lines 150 which converge on it.

Therefore one problem that arises and that the present invention is designed to resolve is to provide a sparkplug that is more reliable and of which the service life is increased.

With this objective, the present invention proposes a sparkplug comprising an induction coil and a central electrode coupled to the induction coil, said induction coil having, in order from an electrical connection terminal of the sparkplug, a first end portion, a central portion, and a second end portion, said central electrode extending in line with the second end portion and away from said central portion, said induction coil having a conducting wire wound helically while forming a succession of coaxial turns, the second end portion having a terminal turn situated opposite the central portion and connected to the central electrode, said induction coil being capable of producing an electrical field induced in said second end portion. According to the invention, the second end portion comprises a plurality of coaxial end turns which extend axially between said terminal turn and an upstream turn situated toward the central portion; and said terminal turn has a diameter smaller than the diameter of the upstream turn, while the turns of the plurality of coaxial end turns have a radius of curvature that reduces progressively between the upstream turn and the terminal turn so as to be able to reduce the intensity of the electrical field induced in the second end portion in the vicinity of the terminal turn.

Thus, one feature of the invention lies in the use of an induction coil of a particular shape of which the second end portion has conducting wire turns for which the diameter reduces progressively from the central portion where the turns are of one and the same diameter, up to the terminal turn. It will be noted that the successive turns formed of a single wound conducting wire do not join but are superposed axially and that consequently the concept of diameter of a turn must be understood as being the diameter of the average circle defined by said turn, and notably in the second end portion where the radius of curvature of the turns reduces in a substantially continuous manner.

With respect to the central portion of the induction coil, the turns define a circular helix formed about an axis A, and their diameter may be defined as being the diameter of the circle of their projection onto a plane perpendicular to this axis.

By virtue of the progressive reduction in the diameter of the turns of the second end portion toward the central high-voltage electrode, the electrical field is distributed over all of these turns while preventing the concentration of the electrical field lines on the last turns in the direction of the central high-voltage electrode, and at least on the terminal turn. Therefore, this terminal turn is no longer the subject of a particularly intense field as is the case in a purely cylindrical induction coil known from the prior art.

By virtue of the invention, a more even distribution of the electrical field lines is obtained over all of the turns of the coil, according to the schematic representation of FIG. 4.

The electrical potential (expressed in volts) increases from the first turn of the first end portion, from where it is powered, up to the upstream turn. It increases notably by virtue of the resonance phenomenon used in this type of sparkplug known as a radiofrequency sparkplug. This potential increases substantially linearly from the first turn to the upstream turn and the associated electrical field (expressed in volts per mm) on the surface of the turns is substantially proportional thereto, because the distance, taken between the turns and the first inner conductive surface connected to ground, is constant, which means that the ratio of the diameters remains constant. This inner surface corresponds to the body of the sparkplug or to a shield consisting of a cylindrical jacket made of a material with very high electrical conductivity.

Then the electrical field evolves differently from the upstream turn to the terminal turn. The electrical potential (expressed in volts) continues to increase between the upstream turn and the terminal turn, while the intensity of the maximum electrical field reduces at the last turns and consequently at the terminal turn. The electrical field is therefore no longer capable of generating sparks at least at the terminal turn, and, in this way, the insulating materials used such as silicone oils or else silicone gels, thoroughly fulfill their role as an insulator without being degraded. Consequently, the service life of the sparkplug is increased without having to introduce new additional parts, notably between the terminal turn and the high-voltage electrode.

However, progressively reducing the diameter of the turns of an induction coil causes a disruption of the magnetic field and the disruption of the magnetic field in its turn causes a reduction in the overall overvoltage ratio of the induction coil, which is undesirable. Therefore, an acceptable compromise is found between the reduction in the electrical stresses obtained through the new shape of the second end portion and the reduction in the electromagnetic losses.

According to one embodiment of the invention that is particularly advantageous, the turns of the plurality of coaxial end turns form a conical spiral so as to attenuate yet more the intensity of the electrical field at the terminal turn.

Moreover, a conducting wire can be made, according to an advantageous variant embodiment, of a copper wire uniformly covered with an insulating film. And this conducting wire is for example wound forming adjacent turns.

In another example, the turns of the plurality of coaxial end turns may be spaced from one another, the spacing being a spacing greater than that caused by an insulating film covering the electrically conducting wire. In this way, the result is not an influence on the electrical field that remains attenuated, but a better distribution of the magnetic field in the zone situated between the upstream turn and the terminal turn and this is because of the spaces between the turns. Naturally, in this configuration, the benefit is still the attenuation of the electrical field.

According to a complementary aspect of the invention, the sparkplug also comprises a conducting connecting part interposed between the terminal turn and the high-voltage central electrode. The conducting wire of the terminal turn is then electrically connected to the connecting part in which the high-voltage central electrode is at least partially engaged. The conducting wire of the terminal turn is preferably welded to the connecting part. The connecting part has an "electrical guard" effect on the terminal turn and above all on the welding of the wire onto the connecting part. The connecting part forms a screen which attenuates the intensity of the electrical field. Specifically, with reference to FIGS. 8 to 10, a divergence of the electrical field lines can be seen between said terminal turn and the connecting part, which means that the electrical field is particularly weak in this zone. The geometrical defect due to the weld (as for any equivalent connecting means), which naturally causes a concentration of the electrical field, therefore no longer tends to cause the formation of an undesired spark.

Advantageously the connecting part is symmetrically cylindrical and it is adjusted coaxially to said plurality of coaxial end turns. In this way, the terminal turn rests uniformly on the connecting part. The connecting part is advantageously made of an alloy with high electrical conductivity based on copper and/or silver and/or aluminum.

Moreover, the sparkplug preferably comprises a cylindrical shield capable of receiving coaxially said induction coil, and the conducting connecting part may have a diameter of between 0.2 and 0.45 times the diameter of said cylindrical shield, and preferably 0.368 (1/e, e being the base of the Naperian logarithms).

This ratio of diameters of 0.368 is the ratio that minimizes the electrical field on the surface of the connecting part.

In addition, the sparkplug advantageously also comprises a coil mandrel having a cylindrical portion and a coaxial frustoconical end, and said conducting wire is wound helically around said frustoconical portion in order to form the second end portion of the induction coil. The coil mandrel forms a support making it possible to wind the conducting wire. The cylindrical portion makes it possible to form the first end portion and the central portion of the induction coil, while the coaxial frustoconical portion makes it possible to form the second end portion, precisely of frustoconical shape.

Moreover, and preferably, said frustoconical end has a generatrix forming an angle of between 5° and 80° with the axis of said frustoconical end. According to a first variant embodiment, in which the coaxial end turns are adjacent, the generatrix and the axis of the frustoconical end advantageously form an angle of between 5° and 45°, preferably around 50°: this is a compromise between the slightest possible reduction in the magnetic field that participates in increasing the electrical potential, and the greatest possible reduction in the associated electrical field. When the turns are spaced from one another, this angle is preferably between 10° and 80°, preferably around 45°. In this embodiment, the preservation of the magnetic field relative to the reduction in the electrical field is a little more promoted, the advantage also lying in the reduction in the length of the frustoconical portion because of the greater angle of the cone. Moreover, notably when the turns are spaced from one another, said frustoconical end of the coil mandrel advantageously has a helical groove in order to receive the conducting wire. In this way, the conducting wire is held in a fixed position and forms turns that are spaced from one another by a predetermined distance.

But other particular features and advantages of the invention will emerge on reading the description made below of particular embodiments of the invention given as an indication and not being limiting, with reference to the appended drawings in which:

FIG. 3 is a schematic view in axial section of a sparkplug according to the invention;

FIG. 4 is a schematic representation of the electrical field being applied between the second end portion of the induction coil and the shield of the sparkplug shown in FIG. 3;

FIG. 5 is a schematic view in detail of the sparkplug shown in FIG. 3 according to a first embodiment of the coil;

FIG. 6 is a schematic view in detail of the sparkplug shown in FIG. 3 according to a second embodiment of the coil;

FIG. 7 is a schematic view in detail of the sparkplug shown in FIG. 3 according to a third embodiment of the coil;

Figure 1:
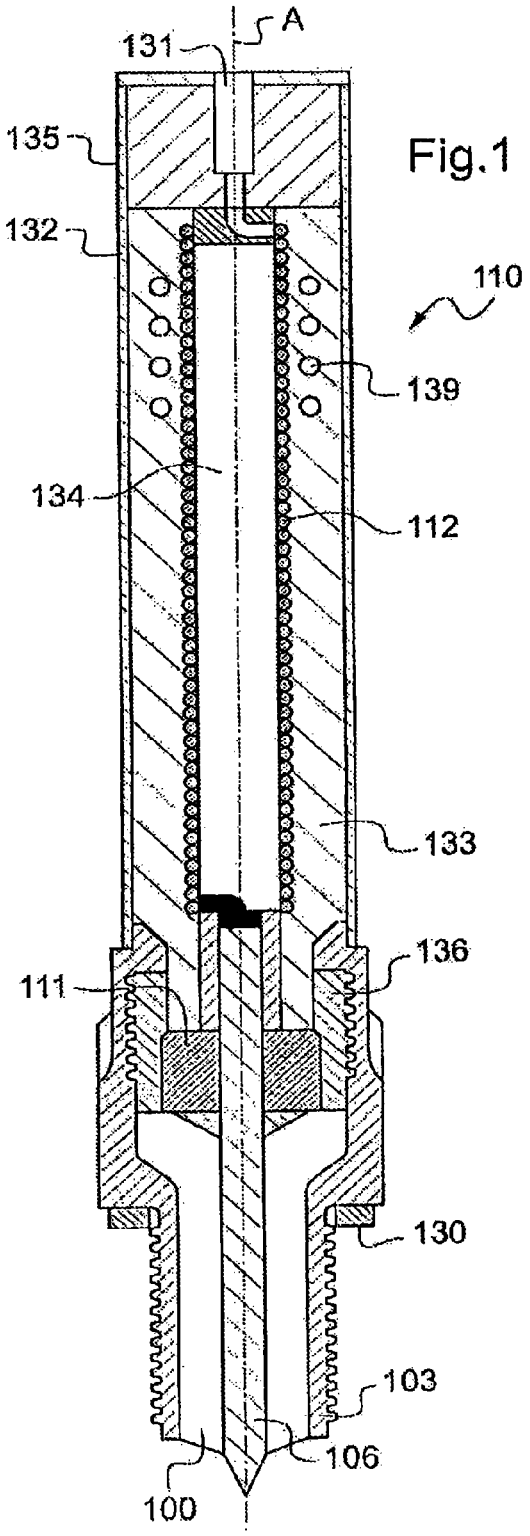
Fig.1 (Related Art)
FIG. 1 is a schematic view in axial section of a sparkplug according to the prior art.
Figure 2:
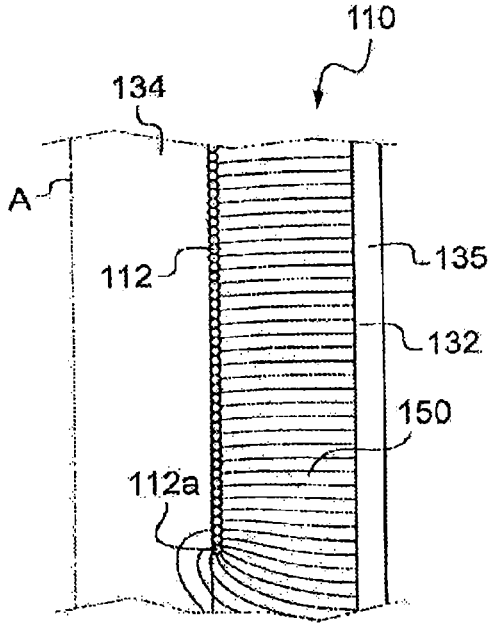
Fig.2 (Related Art)
FIG. 2 is a schematic representation of the electrical field being applied between the second end portion of the induction coil and the shield of the sparkplug shown in FIG. 1.

FIG. 3 illustrates a sparkplug 10 for a heat engine with controlled ignition, also called a radiofrequency plasma sparkplug. It extends longitudinally along an axis of symmetry A between a sparkplug tip 12 and a sparkplug tail 14. The sparkplug tip 12 comprises a cap which has a shoulder 17 and an outer thread 18 making it possible to precisely screw the cap 16 inside a tapping not shown and which is made in the cylinder head of the engines. A copper seal may be fitted to the shoulder around the outer thread 18. The tapping leads inside the combustion chamber of the engine cylinders.

The sparkplug tip 12 comprises a high-voltage central electrode 24. This high-voltage central electrode 24 extends longitudinally and coaxially inside the cap 16 to emerge at the end of the sparkplug tip 12. Furthermore it has a pointed end 25. In addition, the sparkplug tip 12 comprises an insulator 26, such as for example a ceramic insulating sleeve, housed inside the cap 16 and traversed by the high-voltage central electrode 24.

The sparkplug tail 14 comprises an induction coil 28 which extends longitudinally and coaxially to the cap 16 and to the high-voltage central electrode 24. It has a first end portion 30, also called a top end portion, and at the other end, a second end portion 32, also called a bottom end portion, and a central portion 34 which extends between the two end portions 30, 32. The high-voltage central electrode 24 extends coaxially in line with the bottom end portion 32 to which it is electrically connected. In one embodiment of the invention, the electrical connection can be made by means of a conducting connecting part 35.

When the sparkplug 10 as shown in FIG. 3 is supplied with electrical power at the connector 52, a ramified spark, or ramified plasma, is capable of being produced from the pointed end of the high-voltage electrode 24, which protrudes from the ceramic insulating sleeve 26.

The induction coil 28 is produced by the helical winding of a conducting wire 36 that can be covered with an insulating film around a coil mandrel 38. The latter is made of an insulating and preferably a magnetic material. It has a cylindrical portion 40 and a coaxial frustoconical end 42 which rests on the conducting connecting part 35. Thus, the conducting wire 36 is wound around the coil mandrel 38; the wire 36 on the one hand forms turns 44 that may be adjacent, with a diameter that is constant and substantially equivalent to the diameter of the mandrel, over its cylindrical portion 40; and on the other hand it is made of coaxial end turns 45 in a spiral of which the radius of curvature decreases progressively, on its coaxial end 42. A particular shape of the induction coil 28 in its bottom end portion 32 will be described in greater detail below.

The sparkplug 10 also comprises an insulating sleeve 48 which is made of a dielectric material and which covers the induction coil 28 with a cylindrical shield 50 which surrounds the insulating sleeve 48. The shield 50 may form part of the body 54 of the sparkplug 10, that is to say of the outer covering of the sparkplug. It may also be distinct from the body 54 of the sparkplug 10. The shield 50 is made of material with high electrical conductivity, for example a copper-based and/or silver-based and/or aluminum-based alloy.

It may consist of a deposit of an alloy layer on the bottom surface of the body 54 of the sparkplug 10. The shield 50 has a substantially constant diameter and it covers, in the example shown in FIG. 3, at least the coil 28.

Moreover, the end of the conducting wire 36 which extends beyond the upper end portion 30 of the induction coil 28, is connected to a connector 52 which emerges on the outside of the sparkplug 10, and which allows connection to an electrical power supply not shown.

Reference will now be made to FIG. 5 illustrating in greater detail the bottom end portion 46 of the induction coil 28, of which the conducting wire is wound around the coaxial frustoconical end 42 of the coil mandrel 38. Also in this FIG. 5, is the connecting part 35 and the cylindrical shield 50. Also shown in this figure are the diameters described in the table below:

Mapping table of the diameters shown in FIG. 5

| | |
|---|---|
| D1 | Inner diameter of the shield 50 |
| D2 | Diameter of the induction coil 28 |
| D3 | Outer diameter of the connecting part 35 |
| D58 | Diameter of the terminal turn 58 |
| D60 | Diameter of the upstream turn 60 |

The inner diameter D1 of the shield 50 is greater than the diameter D2 of the induction coil 28. "Inner diameter D1" means the diameter of the first conducting surface facing notably the coil 28. According to a particularly advantageous embodiment of the invention, the ratio of the outer diameter D2 and of the inner diameter D1 is between 0.45 and 0.60 and preferably close to 0.56.

$$\frac{D2}{D1} \in [0.45 - 0.60]$$

The conducting connecting part 35 is also symmetrically cylindrical, with an outer diameter D3 smaller than the inner diameter D1 of the shield 50. According to a particularly advantageous embodiment, the outer diameter D3 is between 0.20 and 0.45 times the diameter D1 and preferably close to 0.368.

$$\frac{D3}{D1} \in [0.20 - 0.45]$$

In the exemplary embodiment shown in FIG. 5, the angle $\alpha$ between a generatrix G of the coaxial frustoconical end 42 and the axis of symmetry A is close to 15°.

In this way, the turns 44 of the conducting wire 36 have a diameter D2 that is substantially constant in the cylindrical portion 40 and substantially equal to the outer diameter of the coil mandrel 38. While the adjacent turns of the lower end portion 46 extend between a terminal turn 58 of which the diameter D58 is substantially equal to that of the top 56 of the coaxial frustoconical end 42 and an upstream turn 60 of which the diameter D60 is substantially equal to that of the base 54 of the coaxial frustoconical end 42. It should be noted that the value of D60 preferably corresponds to the value of D2.

The terminal turn 58 therefore has a diameter D58 that is less than the diameter D60 of the upstream turn 60. The diameter D58 is chosen in relation to the diameter D1 so that the ratio D58/D1 is between 0.2 and 0.45 and preferably close to 0.368.

And between these two turns, the radius of curvature of the end coaxial turns 45 of the lower end portion 46 decreases, preferably in a continuous manner, between the upstream turn 60 and the terminal turn 58, around the coaxial frustoconical end 42 on which they rest.

With reference to FIGS. 3 and 5 to 10, the terminal turn 58 may rest against a surface of the connecting part 35, this surface preferably being perpendicular to the axis A. Also, the end of the conducting wire which extends the terminal turn 58 may be welded to the connecting part 35. In this embodiment, which comprises the connecting part 35, the diameter D58 may be reduced, the ratio D58/D1 then being able to be markedly less than 0.368.

By virtue of the particular shape of the turns of the lower end portion 46, of which the diameter reduces progressively from the upstream turn 60 to the terminal turn 58, the electrical field is not linear in the extension of the cylindrical central portion 34 of the induction coil 28. It increases steadily from the upper end portion 30 to the upstream turn 60, and then, by virtue of the change of slope, it is maintained, or even is attenuated up to the terminal turn 58, the maintenance or the reduction depending notably on the angle α. The electrical field at this last turn 58 is less than the field that can destroy the insulating materials. It therefore makes it possible to preserve the insulating materials that surround it.

In addition, by virtue of the connecting part 35, an "electrical guard" effect is obtained on the terminal turn 58 and also on the weld of the end of the conducting wire which escapes therefrom in order to join the connecting part 35.

It will be observed that the diameter of the turns of the lower end portion 46 decreases in the example shown in FIGS. 3 to 10 in a linear manner. It is not at all out of the question to provide a decrease according to a different monotone arithmetic progression.

A second embodiment of the invention is illustrated in FIG. 6 where all the detail elements already illustrated in FIG. 3 appear. It will be observed that the end coaxial turns 45' in a conical spiral of the lower end portion 46', which extend between the upstream turn 60 and the terminal turn 58, are spaced from one another. Only the turns in a conical spiral and the lower end portion 46' bear one and the same reference with a "'" sign added, because they differ from those of the previous example simply in that the turns are adjacent.

Figure 10:
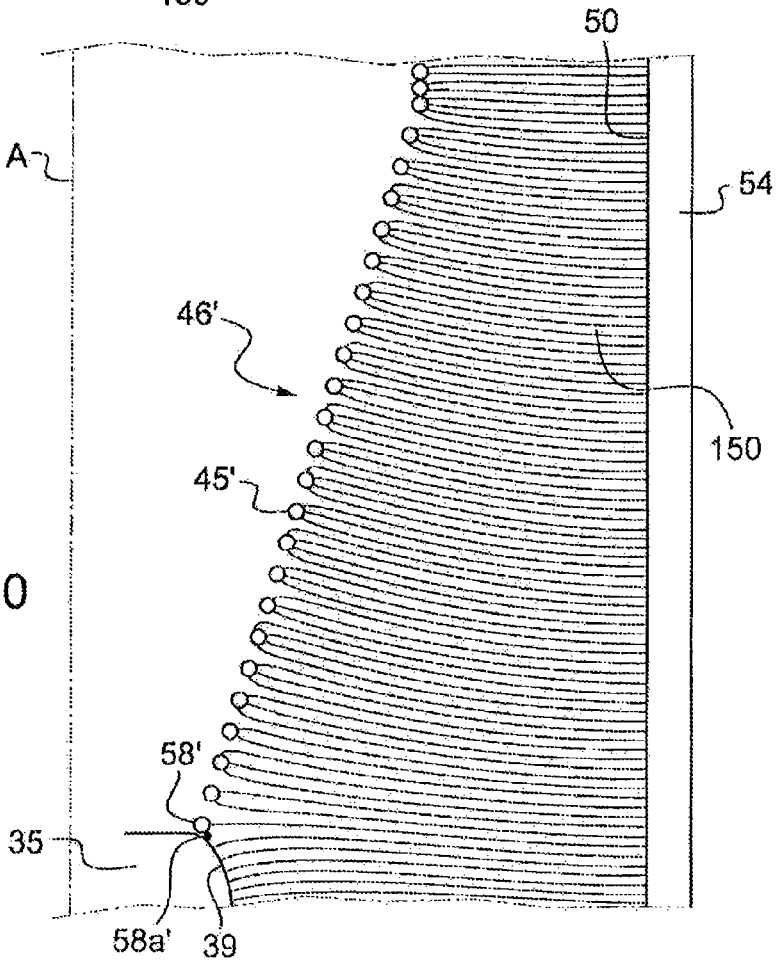
FIG. 10 is similar to FIGS. 8 and 9 for the second and the third embodiment of the coil of FIGS. 6 and 7.

By virtue of the spacing of the end coaxial turns 45' in a conical spiral, a screening of the electrical field is still obtained due to the frustoconical lower end portion 46', but in addition, a better distribution of the magnetic field is obtained in this frustoconical zone. The angle a of the generatrix relative to the axis of symmetry A may then be greater than in the previous embodiment. It is preferably between 10° and 80°, with a very good compromise at 45°. FIG. 10 represents schematically the electrical field which operates in this embodiment. It may be noted in this schematic representation that the concentration of the field lines is greater than in the first embodiment in adjacent turns. This is why a larger angle a than in the first embodiment will be preferred so as to compensate for a stronger electrical field with a less disrupted magnetic field promoting a better overvoltage factor.

According to a second embodiment of the invention, and according to a variant embodiment illustrated in FIG. 7, it is possible to arrange a helical groove 62 in a conical spiral in the coaxial frustoconical end 42 so as to be able to insert therein, in a given position, the conical spiral turns 45' spaced from one another between the upstream turn 60 and the terminal turn 58.

In this way, the conical spiral turns 45' are held axially in a fixed position on the inclined slopes of the coaxial frustoconical end 42.

The connecting part 35, in a variant embodiment, may form an integral part of the high-voltage central electrode 24. Whether or not it is incorporated into the high-voltage central electrode 24, the connecting part 35 has an outer geometry adapted to minimizing the electrical field on its surface.

The terminal turn 58 may rest against a surface of the connecting part 35, this surface preferably be perpendicular to the axis A. Also, this end of the conducting wire which extends the terminal turn 58 may be welded to the connecting part 35.

Thus, the connecting part 35 comprises at least one bearing surface and one surface of revolution, the two surfaces being connected together by a connecting fillet.

The bearing surface is designed notably to receive the terminal turn 58. This surface is preferably perpendicular to the axis of revolution A of the sparkplug 10.

The end of the wire of the terminal turn 58 (or 58') is electrically connected to the conducting connecting part 35 in a zone of divergence of the electrical field lines 150. The connecting part 35 has an "electrical guard" effect on the terminal turn 58 and above all on the weld **58*a* (or 58*a*') of the wire on the connecting part 35. The connecting part 35 forms a screen which attenuates the intensity of the electrical field at the weld, by virtue of the surface areas that are present. Specifically, with reference to FIGS. 8 to 10, it is possible to see a divergence of the electrical field lines between said terminal turn 58 (or 58*a*') and the connecting part 35, which means that the electrical field is particularly weak in this zone. The geometric defect due to the weld 58*a* (or 58*a*'**) which naturally causes a concentration of the electrical field therefore no longer tends to cause the formation of an undesired spark. This is the case for any equivalent connecting means.

In order to achieve it, the bearing surface, extended by the connecting fillet, is defined so as to cause this divergence of the electrical field lines. One way of achieving it is for the angle of the bearing surface relative to the axis of the generatrix G to be less than 180°.

The surface of revolution has the diameter D3 described above which depends on the inner diameter D1 of the shield 50.

Figure 8:
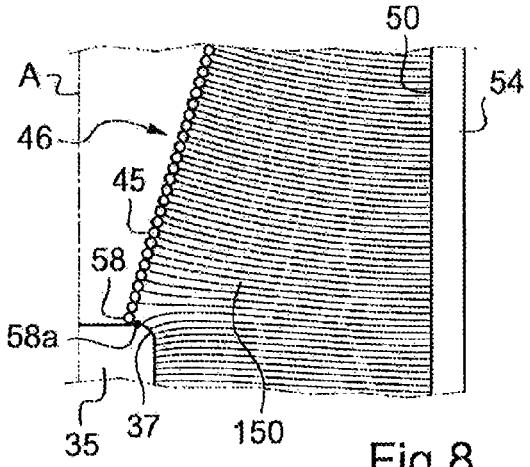
FIG. 8 is a schematic representation of the electrical field being applied between the last turns of the induction coil, the connecting part, and the shield of the sparkplug shown in FIG. 3.

With reference to FIG. 8, a connecting fillet 37 connects the bearing surface and the surface of revolution. Seen from in a section of the part 35 as is the situation in FIG. 3, this connecting fillet 37 corresponds to an arc of a circle tangential to the two surfaces. The connecting fillet 37 is used to distribute the electrical field in order to prevent a concentration of the field lines. The terminal turn 58 (or 58') is preferably placed as close as possible to the zone of junction between the bearing surface and the connecting fillet.

Figure 9:
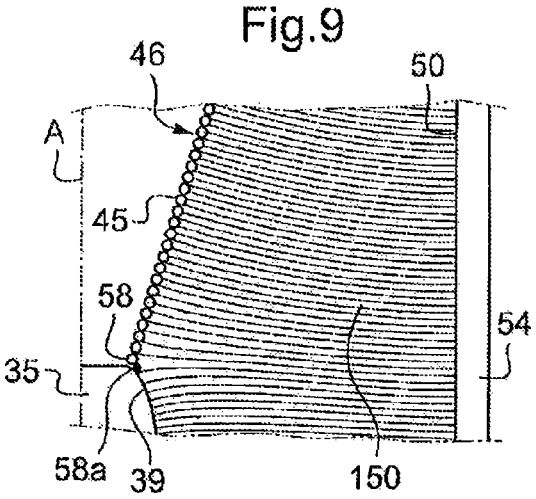
FIG. 9 is similar to FIG. 8 for a variant embodiment of the connecting part.

A variant embodiment of the connecting fillet is shown in FIG. 9. In this figure, in comparison with FIG. 8, the fillet 39 is of elliptical shape in order to increasingly optimize the distribution of the electrical field lines. The corresponding elliptical arc has a half large axis in the direction of axis A, while the small half axis extends radially relative to the axis A.

The invention claimed is:

1. A sparkplug comprising:

an induction coil; and a central electrode fixedly connected to the induction coil;

the induction coil including, in order from an electrical connection terminal of the sparkplug, a first end portion, a central portion, and a second end portion;

the central electrode extending in line with the second end portion and away from the central portion;

the induction coil including a conducting wire wound helically while forming a succession of coaxial turns, the second end portion having a terminal turn situated opposite the central portion and connected to the central electrode, the induction coil configured to produce an electrical field induced in the second end portion;

wherein the second end portion comprises a plurality of coaxial end turns that extend axially between the terminal turn and an upstream turn situated toward the central portion; and wherein the terminal turn has a diameter smaller than the diameter of the upstream turn, while the turns of the plurality of coaxial end turns have a radius of curvature that reduces progressively between the upstream turn and the terminal turn so as to be able to reduce intensity of the electrical field induced in the second end portion in a vicinity of the terminal turn.

2. The sparkplug as claimed in claim 1, wherein the turns of the plurality of coaxial end turns form a conical spiral.

3. The sparkplug as claimed in claim 1, wherein the turns of the plurality of coaxial end turns are spaced from one another.

4. The sparkplug as claimed in claim 1, further comprising a conductive connecting part interposed between the terminal turn and the central electrode.

5. The sparkplug as claimed in claim 4, wherein the conductive connecting part is symmetrically cylindrical, and is adjusted coaxially to the plurality of coaxial end turns.

6. The sparkplug as claimed in claim 5, further comprising a cylindrical shield configured to receive coaxially the induction coil and the connecting part, and the conductive connecting part has a diameter of between 0.2 and 0.45 times the diameter of the cylindrical shield.

7. The sparkplug as claimed in claim 4, wherein the end of the wire of the terminal turn is electrically connected to the conductive connecting part in a zone of divergence of the electrical field lines.

8. The sparkplug as claimed in claim 1, further comprising a coil mandrel including a cylindrical portion and a coaxial frustoconical end, and the conducting wire is wound helically at least around the frustoconical end to form the second end portion of the induction coil.

9. The sparkplug as claimed in claim 8, wherein the coaxial frustoconical end has a generatrix forming an angle of between 5° and 80° with the axis of the coaxial frustoconical end.

10. The sparkplug as claimed in claim 8, wherein the coaxial frustoconical end of the coil mandrel includes a helical groove to receive the conducting wire.

11. The sparkplug as claimed in claim 1, wherein the central electrode has an end surface that produces an ignition spark when the sparkplug is supplied with electrical power.

12. The sparkplug as claimed in claim 11, wherein the ignition spark is a ramified spark.

13. The sparkplug as claimed in claim 4, wherein the terminal turn is fixedly attached to the conductive connecting part by a weld.

14. The sparkplug as claimed in claim 4, further comprising a coil mandrel including a cylindrical portion and a coaxial frustoconical end, and the conducting wire is wound helically at least around the frustoconical end to form the second end portion of the induction coil, wherein the terminal turn is fixedly attached to the conductive connecting part by the coil mandrel.

15. The sparkplug as claimed in claim 4, wherein a fillet between a top surface of the conductive connecting part and a side surface thereof has the shape of an elliptical arc.

16. The sparkplug as claimed in claim 4, wherein the terminal turn is directly connected to the conductive connecting part and the conductive connecting part is directly connected to the central electrode.

17. The sparkplug as claimed in claim 16, further comprising a coil mandrel including a cylindrical portion and a coaxial frustoconical end, and the conducting wire is wound helically at least around the frustoconical end to form the second end portion of the induction coil, wherein the conductive connecting part has a first cavity that engages with a tip portion of the frustoconical end of the coil mandrel, and a second cavity that engages with an end portion of the central electrode.

18. The sparkplug as claimed in claim 16, wherein the cylindrical shield includes an electrically conductive material deposited on one or more surfaces of a body of the sparkplug.

19. An ignition system for an internal combustion engine, comprising the sparkplug as claimed in claim 1 and an electrical power supply.

20. An internal combustion engine, comprising the sparkplug as claimed in claim 1.

* * * * *